US008668006B2

(12) United States Patent
Xu

(10) Patent No.: US 8,668,006 B2
(45) Date of Patent: Mar. 11, 2014

(54) BALL SEAT HAVING BALL SUPPORT MEMBER

(75) Inventor: Ying Qing Xu, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 323 days.

(21) Appl. No.: 13/085,637

(22) Filed: Apr. 13, 2011

(65) Prior Publication Data

US 2012/0261115 A1 Oct. 18, 2012

(51) Int. Cl.
*E21B 34/08* (2006.01)

(52) U.S. Cl.
USPC ..... 166/193; 166/192

(58) Field of Classification Search
None
See application file for complete search history.

(56) References Cited

U.S. PATENT DOCUMENTS

| | | | |
|---|---|---|---|
| 1,883,071 | A | 10/1932 | Stone |
| 2,117,539 | A | 5/1938 | Baker et al. |
| 2,769,454 | A | 11/1956 | Bletcher et al. |
| 2,822,757 | A | 2/1958 | Coberly |
| 2,829,719 | A | 4/1958 | Clark, Jr. |
| 2,857,972 | A | 10/1958 | Baker et al. |
| 2,973,006 | A | 2/1961 | Nelson |
| 3,007,527 | A | 11/1961 | Nelson |
| 3,013,612 | A | 12/1961 | Angel |
| 3,043,903 | A | 7/1962 | Keane et al. |
| 3,090,442 | A | 5/1963 | Cochran et al. |
| 3,211,232 | A | 10/1965 | Grimmer |
| 3,220,481 | A | 11/1965 | Park |
| 3,220,491 | A | 11/1965 | Mohr |
| 3,510,103 | A | 5/1970 | Carsello |
| 3,566,964 | A | 3/1971 | Livingston |
| 3,667,505 | A | 6/1972 | Radig |
| 3,727,635 | A | 4/1973 | Todd |
| 3,776,258 | A | 12/1973 | Dockins, Jr. |

(Continued)

FOREIGN PATENT DOCUMENTS

| | | | |
|---|---|---|---|
| CA | 2460712 | | 4/2005 |
| EP | 0518371 | A3 | 12/1992 |
| WO | WO/02 068793 | A1 | 9/2002 |
| WO | WO 03006787 | A1 | 1/2003 |

OTHER PUBLICATIONS

D.W. Thomson, et al., Design and Installation of a Cost-Effective Completion System for Horizontal Chalk Wells Where Multiple Zones Require Acid Stimulation, SPE Drilling & Completion, Sep. 1998, pp. 151-156, Offshore Technology Conference, U.S.A.

(Continued)

*Primary Examiner* — Jennifer H Gay
*Assistant Examiner* — Caroline Butcher
(74) *Attorney, Agent, or Firm* — Parsons Behle & Latimer

(57) ABSTRACT

Apparatuses for restricting fluid flow through a well conduit comprise a tubular member having an inner wall surface defining a bore and a seat in sliding engagement with the inner wall surface. Operatively associated with the seat is a plug element support member having an expanded position when the apparatus is in a run-in position and a contracted position when the apparatus is in a set position. A plug element adapted to be disposed into the bore and landed on the seat to restrict fluid flow through the bore and the well conduit is used to move the seat which in turn moves the plug element support member from the expanded position to the contracted position, thereby providing support to the plug member landed on the seat.

8 Claims, 2 Drawing Sheets

(56) References Cited

U.S. PATENT DOCUMENTS

| | | | | |
|---|---|---|---|---|
| 3,901,315 | A | 8/1975 | Parker et al. | |
| 4,114,694 | A | 9/1978 | Dinning | |
| 4,160,478 | A | 7/1979 | Calhoun et al. | |
| 4,194,566 | A | 3/1980 | Maly | |
| 4,291,722 | A | 9/1981 | Churchman | |
| 4,292,988 | A | 10/1981 | Montgomery | |
| 4,314,608 | A | 2/1982 | Richardson | |
| 4,374,543 | A | 2/1983 | Richardson | |
| 4,390,065 | A | 6/1983 | Richardson | |
| 4,448,216 | A | 5/1984 | Speegle et al. | |
| 4,478,279 | A | 10/1984 | Puntar et al. | |
| 4,510,994 | A | 4/1985 | Pringle | |
| 4,520,870 | A | 6/1985 | Pringle | |
| 4,537,255 | A | 8/1985 | Regalbuto et al. | |
| 4,537,383 | A | 8/1985 | Fredd | |
| 4,576,234 | A | 3/1986 | Upchurch | |
| 4,583,593 | A | 4/1986 | Zunkel et al. | |
| 4,669,538 | A | 6/1987 | Szarka | |
| 4,729,432 | A | 3/1988 | Helms | |
| 4,823,882 | A | 4/1989 | Stokley et al. | |
| 4,826,135 | A | 5/1989 | Mielke | |
| 4,828,037 | A | 5/1989 | Lindsey et al. | |
| 4,848,691 | A | 7/1989 | Muto et al. | |
| 4,862,966 | A | 9/1989 | Lindsey et al. | |
| 4,893,678 | A * | 1/1990 | Stokley et al. | 166/374 |
| 4,915,172 | A | 4/1990 | Donovan et al. | |
| 4,949,788 | A | 8/1990 | Szarka et al. | |
| 4,991,654 | A | 2/1991 | Brandell et al. | |
| 5,056,599 | A | 10/1991 | Comeaux et al. | |
| 5,146,992 | A | 9/1992 | Baugh | |
| 5,244,044 | A | 9/1993 | Henderson | |
| 5,246,203 | A | 9/1993 | McKnight et al. | |
| 5,297,580 | A | 3/1994 | Thurman | |
| 5,309,995 | A | 5/1994 | Gonzalez et al. | |
| 5,333,689 | A | 8/1994 | Jones et al. | |
| 5,335,727 | A | 8/1994 | Cornette et al. | |
| 5,413,180 | A | 5/1995 | Ross et al. | |
| 5,479,986 | A | 1/1996 | Gano et al. | |
| 5,501,276 | A | 3/1996 | Weaver et al. | |
| 5,558,153 | A | 9/1996 | Holcombe et al. | |
| 5,577,560 | A | 11/1996 | Coronado et al. | |
| 5,607,017 | A | 3/1997 | Owens et al. | |
| 5,623,993 | A | 4/1997 | Van Buskirk et al. | |
| 5,685,372 | A | 11/1997 | Gano | |
| 5,704,393 | A | 1/1998 | Connell et al. | |
| 5,709,269 | A | 1/1998 | Head | |
| 5,762,142 | A | 6/1998 | Connell et al. | |
| 5,765,641 | A | 6/1998 | Shy et al. | |
| 5,813,483 | A | 9/1998 | Latham et al. | |
| 5,960,881 | A | 10/1999 | Allamon et al. | |
| 5,992,289 | A | 11/1999 | George et al. | |
| 6,003,607 | A | 12/1999 | Hagen et al. | |
| 6,026,903 | A | 2/2000 | Shy et al. | |
| 6,050,340 | A | 4/2000 | Scott | |
| 6,053,248 | A | 4/2000 | Ross | |
| 6,053,250 | A | 4/2000 | Echols | |
| 6,062,310 | A | 5/2000 | Wesson et al. | |
| 6,076,600 | A | 6/2000 | Vick, Jr. et al. | |
| 6,079,496 | A | 6/2000 | Hirth | |
| 6,102,060 | A | 8/2000 | Howlett et al. | |
| 6,155,350 | A | 12/2000 | Melenyzer | |
| 6,161,622 | A | 12/2000 | Robb et al. | |
| 6,189,618 | B1 | 2/2001 | Beeman et al. | |
| 6,220,350 | B1 | 4/2001 | Brothers et al. | |
| 6,279,656 | B1 | 8/2001 | Sinclair et al. | |
| 6,289,991 | B1 | 9/2001 | French | |
| 6,293,517 | B1 | 9/2001 | Cunningham | |
| 6,382,234 | B1 | 5/2002 | Birkhead et al. | |
| 6,397,950 | B1 | 6/2002 | Streich et al. | |
| 6,431,276 | B1 | 8/2002 | Robb et al. | |
| 6,457,517 | B1 | 10/2002 | Goodson et al. | |
| 6,467,546 | B2 | 10/2002 | Allamon et al. | |
| 6,530,574 | B1 | 3/2003 | Bailey et al. | |
| 6,547,007 | B2 | 4/2003 | Szarka et al. | |
| 6,634,428 | B2 | 10/2003 | Krauss et al. | |
| 6,666,273 | B2 | 12/2003 | Laurel | |
| 6,668,933 | B2 | 12/2003 | Kent | |
| 6,708,946 | B1 | 3/2004 | Edwards et al. | |
| 6,779,600 | B2 | 8/2004 | King et al. | |
| 6,834,726 | B2 | 12/2004 | Giroux et al. | |
| 6,848,511 | B1 | 2/2005 | Jones et al. | |
| 6,866,100 | B2 | 3/2005 | Gudmestad et al. | |
| 6,896,049 | B2 | 5/2005 | Moyes | |
| 6,926,086 | B2 | 8/2005 | Patterson et al. | |
| 6,966,368 | B2 | 11/2005 | Farquhar | |
| 7,021,389 | B2 | 4/2006 | Bishop et al. | |
| 7,093,664 | B2 | 8/2006 | Todd et al. | |
| 7,150,326 | B2 | 12/2006 | Bishop et al. | |
| 7,311,118 | B2 | 12/2007 | Doutt | |
| 7,325,617 | B2 | 2/2008 | Murray | |
| 7,350,582 | B2 | 4/2008 | McKeachnie et al. | |
| 7,353,879 | B2 | 4/2008 | Todd et al. | |
| 7,395,856 | B2 | 7/2008 | Murray | |
| 7,416,029 | B2 | 8/2008 | Telfer et al. | |
| 7,464,764 | B2 | 12/2008 | Xu | |
| 7,469,744 | B2 | 12/2008 | Ruddock et al. | |
| 7,503,392 | B2 | 3/2009 | King et al. | |
| 7,625,846 | B2 | 12/2009 | Cooke, Jr. | |
| 7,628,210 | B2 | 12/2009 | Avant et al. | |
| 7,640,991 | B2 | 1/2010 | Leising | |
| 7,644,772 | B2 * | 1/2010 | Avant et al. | 166/373 |
| 7,673,677 | B2 | 3/2010 | King et al. | |
| 2002/0162661 | A1 | 11/2002 | Krauss et al. | |
| 2003/0037921 | A1 | 2/2003 | Goodson | |
| 2003/0141064 | A1 | 7/2003 | Roberson, Jr. | |
| 2003/0168214 | A1 | 9/2003 | Sollesnes | |
| 2004/0108109 | A1 | 6/2004 | Allamon et al. | |
| 2005/0061372 | A1 | 3/2005 | McGrath et al. | |
| 2005/0092363 | A1 | 5/2005 | Richard et al. | |
| 2005/0092484 | A1 | 5/2005 | Evans | |
| 2005/0126638 | A1 | 6/2005 | Gilbert | |
| 2005/0161224 | A1 | 7/2005 | Starr et al. | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2005/0281968 | A1 | 12/2005 | Shanholtz et al. | |
| 2006/0021748 | A1 | 2/2006 | Swor et al. | |
| 2006/0131031 | A1 | 6/2006 | McKeachnie et al. | |
| 2006/0175092 | A1 | 8/2006 | Mashburn | |
| 2006/0213670 | A1 | 9/2006 | Bishop et al. | |
| 2006/0243455 | A1 | 11/2006 | Telfer et al. | |
| 2006/0266518 | A1 | 11/2006 | Woloson | |
| 2007/0023087 | A1 | 2/2007 | Krebs et al. | |
| 2007/0029080 | A1 | 2/2007 | Moyes | |
| 2007/0062706 | A1 | 3/2007 | Leising | |
| 2007/0074873 | A1 | 4/2007 | McKeachnie et al. | |
| 2007/0169935 | A1 | 7/2007 | Akbar et al. | |
| 2007/0295507 | A1 | 12/2007 | Telfer | |
| 2008/0017375 | A1 | 1/2008 | Wardley | |
| 2008/0066923 | A1 | 3/2008 | Xu | |
| 2008/0066924 | A1 | 3/2008 | Xu | |
| 2008/0217025 | A1 | 9/2008 | Ruddock et al. | |
| 2009/0025927 | A1 | 1/2009 | Telfer | |
| 2009/0044946 | A1 | 2/2009 | Schasteen et al. | |
| 2009/0044948 | A1 | 2/2009 | Avant et al. | |
| 2009/0044949 | A1 | 2/2009 | King et al. | |
| 2009/0044955 | A1 | 2/2009 | King et al. | |
| 2009/0107684 | A1 | 4/2009 | Cooke, Jr. | |
| 2010/0032151 | A1 | 2/2010 | Duphorne | |
| 2010/0132954 | A1 | 6/2010 | Telfer | |
| 2011/0187062 | A1 | 8/2011 | Xu | |
| 2011/0315390 | A1 | 12/2011 | Guillory et al. | |
| 2012/0012771 | A1 | 1/2012 | Korkmaz et al. | |
| 2012/0048556 | A1 | 3/2012 | O'Connell et al. | |
| 2012/0261115 | A1 | 10/2012 | Xu | |

OTHER PUBLICATIONS

H.A. Nasr-El-Din, et al., Laboratory Evaluation Biosealers, Feb. 13, 2001, pp. 1-11, SPE 65017, Society of Petroleum Engineers Inc., U.S.A.

Baker Hughes Incorporated. Model "E" Hydro-Trip Pressure Sub, Product Family No. H79928, Sep. 25, 2003, pp. 1-4, Baker Hughes Incorporated, Houston, Texas USA.

(56) References Cited

OTHER PUBLICATIONS

Innicor Completion Systems, HydroTrip Plug Sub, Product No. 658-0000, Jul. 26, 2004, p. 1, Innicor Completion Systems, Canada.
K.L. Smith, et al., "Ultra-Deepwater Production Systems Technical Progress Report," U.S. Department of Energy, Science and Technical Information, Annual Technical Progress Report, Jan. 2005, pp. 1-32, ConocoPhillips Company, U.S.A.
X. Li, et al., An Integrated Transport Model for BallSealer Diversion in Vertical and Horizontal Wells, Oct. 9, 2005, pp. 1-9, SPE 96339, Society of Petroleum Engineers, U.S.A.
G.L. Rytlewski, A Study of Fracture Initiation Pressures in Cemented Cased Hole Wells Without Perforations, May 15, 2006, pp. 1-10, SPE 100572, Society of Petroleum Engineers, U.S.A.
StageFRAC Maximize Reservoir Drainage, 2007, pp. 1-2, Schlumberger, U.S.A.
Brad Musgrove, Multi-Layer Fracturing Solution Treat and Produce Completions, Nov. 12, 2007, pp. 1-23, Schlumberger, U.S.A.
Notification of Transmittal of the International Search Report and the Written Opinion of the International Searching Authority, Or the Declaration, Oct. 31, 2012, pp. 1-2, PCT/US2012/029466, Korean Intellectual Property Office.
International Search Report, Oct. 31, 2012, pp. 1-4, PCT/US2012/029466, Korean Intellectual Property Office.
Written Opinion of the International Searching Authority, Oct. 31, 2012, pp. 1-4, PCT/US2012/029466, Korean Intellectual Property Office.

* cited by examiner

BALL SEAT HAVING BALL SUPPORT MEMBER

BACKGROUND

1. Field of Invention

The present invention is directed to plug member seats for use in oil and gas wells and, in particular, to plug member seats having a seat support member that provides support to the plug member in addition to the support provided by the seat.

2. Description of Art

Ball seats are generally known in the art. For example, typical ball seats have a bore or passageway that is restricted by a seat. The ball or drop plug is disposed on the seat, preventing or restricting fluid from flowing through the bore of the ball seat and, thus, isolating the tubing or conduit section in which the ball seat is disposed. As the fluid pressure above the ball or drop plug builds up, the conduit can be pressurized for tubing testing or actuating a tool connected to the ball seat such as setting a packer. Ball seats are also used in cased hole completions, liner hangers, flow diverters, frac systems, and flow control equipment and systems.

Although the terms "ball seat" and "ball" are used herein, it is to be understood that a drop plug or other shaped plugging device or element may be used with the "ball seats" disclosed and discussed herein. For simplicity it is to be understood that the term "ball" includes and encompasses all shapes and sizes of plugs, balls, or drop plugs unless the specific shape or design of the "ball" is expressly discussed.

As mentioned above, all seats allow a ball to land and make a partial or complete seal between the seat and the ball during pressurization. The contact area between the ball and the inner diameter of the seat provides the seal surface. Generally, the total contact area or bearing surface between the ball and the seat is determined by the outer diameter of the ball and the inner diameter of seat. The outer diameter of the contact area is determined by the largest diameter ball that can be transported down the conduit. The inner diameter of the seat is determined by the allowable contact stress the ball can exert against the contact area and/or the required inner diameter to allow preceding passage of plug elements or tools, and/or subsequent passage of tools after the plug element is removed, through the inner diameter of the seat.

The seat is usually made out of a metal that can withstand high contact forces due to its high yield strength. The ball, however, is typically formed out of a plastic material that has limited compressive strength. Further, the contact area between the ball and seat is typically minimized to maximize the seat inner diameter for the preceding passage of balls, plug elements, or other downhole tools. Therefore, as the ball size becomes greater, the contact stresses typically become higher due to the increasing ratio of the cross-section of the ball exposed to pressure compared to the cross-section of the ball in contact with the seat. This higher contact pressure has a propensity to cause the plastic balls to fail due to greater contact stresses.

The amount of contact pressure a particular ball seat can safely endure is a direct function of the ball outer diameter, seat inner diameter, applied tubing pressure, and ball strength. Because of limited ball strength as discussed above, the seat inner diameter is typically reduced to increase the contact area (to decrease contact stress). The reduced seat inner diameter forces the ball previously dropped through the seat inner diameter to have a smaller outer diameter to pass through this seat inner diameter. This reduction in outer diameter of the previous balls continues throughout the length of conduit until ball seats can no longer be utilized. Therefore, a string of conduit is limited as to the number of balls (and, thus ball seats) that can be used which reduces the number of actuations that can be performed through a given string of conduit.

SUMMARY OF INVENTION

Broadly, ball seats having a housing, a seat, and a plug element such as a ball are disclosed. Typically, the ball is landed and the conduit is pressurized to a predetermined pressure. Upon pressurization of the conduit so that the ball is pushed into the seat, the plug element support member extends from its expanded position, i.e., the position in which the plug element support member is not touching or otherwise in engagement with the ball or a bottom surface of the seat, and into the bore of the ball seat to engage with the ball and/or the bottom surface of the seat, to provide additional support to the ball as it is being pressurized. In other words, the force of the ball into the seat by the pressure in the tubing causes the seat to move the plug element support member inward into the bore of the ball seat from its expanded position toward the centerline (or axis) of the bore of the ball seat and into its contracted positions, thus either making contact with the previously unsupported area of the ball or otherwise distributing the force acting on the ball over a larger surface area so that the ball and seat can withstand higher pressures and/or restrict movement of the ball through the seat inner diameter as the pressure begins to deform and extrude the ball through the seat.

By making contact with, or engaging, the ball or the bottom surface of the seat, the plug element support members provide support for the ball because the resulting force against the ball caused by pressurization of the ball against the seat is spread out between the existing seat contact area and the additional contact area provided by the contracted plug element support member. As the pressure is increased, the force on the ball is transferred to both the original seal area of the seat and to the plug element support member. The applied pressure to the plug element support member, therefore, decreases the likelihood that the force on the ball will push the ball through the seat.

Due to the plug element support member providing additional support to the ball, the ball seats disclosed herein provide a plugging method where higher pressure can be exerted onto a seat by a lower strength ball without exceeding the ball's bearing or load strength. Further, the contact pressure resulting from having additional contact area provided by the plug element support members will be effectively reduced without affecting the sealability of the ball. Thus, more sizes of balls in closer increments can be utilized in various applications such as in frac ball systems. Additionally, more balls can be used because the seat inner diameter of subsequent seats can be larger due to the seat inner diameter of the seats of each ball seat in the conduit being larger. This allows more balls to go through the conduit because the seat inner diameters are larger throughout the length of conduit. Because more balls or plug elements can travel through frac ball systems, more producible zones can be isolated by a single frac ball system.

Thus, additional contact area is provided by the plug element support member that allows a greater pressure to be exerted onto the ball while keeping the original seat inner diameter the same or, alternatively, allows a larger seat inner diameter without requiring a reduction in the pressure acting on the ball to prevent the ball from failing. The additional contact area also allows the contact pressure resulting from the tubing pressure onto the ball to be distributed to the standard seat contact area between the seat and the ball and the new contact areas between the engagement surface of the plug element support member and the ball, i.e., the surface of the plug element support member that engages with the ball.

In one embodiment, an apparatus for restricting flow through a well conduit is disclosed. The apparatus has a run-in position and a set position and comprises a tubular member having a longitudinal bore defined by an inner wall surface. A ramp surface is disposed on the inner wall surface of the tubular member. The ramp surface transitions the inner wall surface of the tubular member from an upper portion having an upper diameter to a lower portion having a lower diameter. The lower diameter is less than the upper diameter. Disposed within the tubular member is a seat comprising a sleeve having an outer wall surface in sliding engagement with the inner wall surface of the tubular member and an inner wall surface. The inner wall surface comprises a plug element engagement surface for receiving the plug element. Operatively associated with the outer wall surface of the sleeve is a plug element support member. The plug element support member is also in sliding engagement with the inner wall surface of the tubular member. In the run in position, the plug element support member is disposed above the ramp surface. After the plug element is landed on the seat and the sleeve is moved downward by the increase in pressure above the seat, the plug element support member slides along the inner wall surface and the ramp surface of the tubular member. As a result, the plug element support member is moved inwardly toward the longitudinal axis of the tubular member. In so doing, the plug element support member engages either the plug element or a bottom surface of the seat sleeve. As a result, the plug element support member provides direct or indirect additional support to the plug element.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
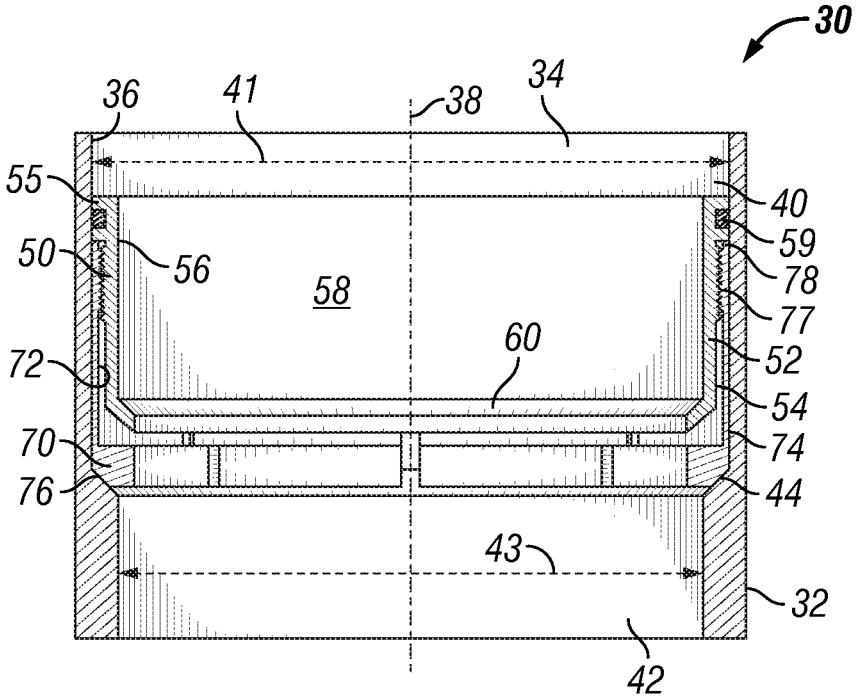
FIG. 1 is a cross-sectional view of a specific embodiment of a ball seat disclosed herein shown in the run-in position.
Figure 2:
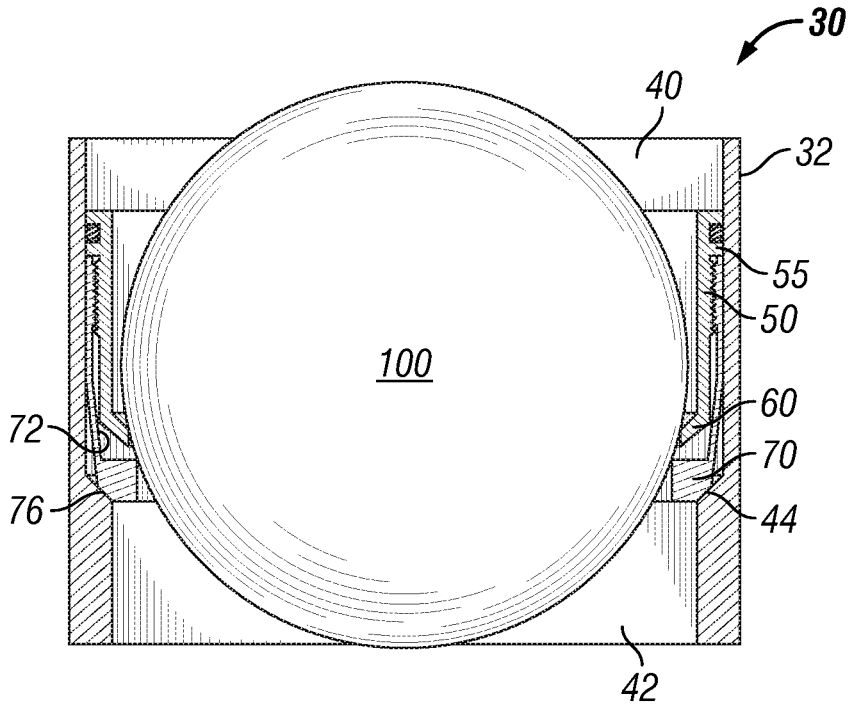
FIG. 2 is a partial cross-sectional view of the ball seat shown in FIG. 1 shown in the actuated or set position.
Figure 3:
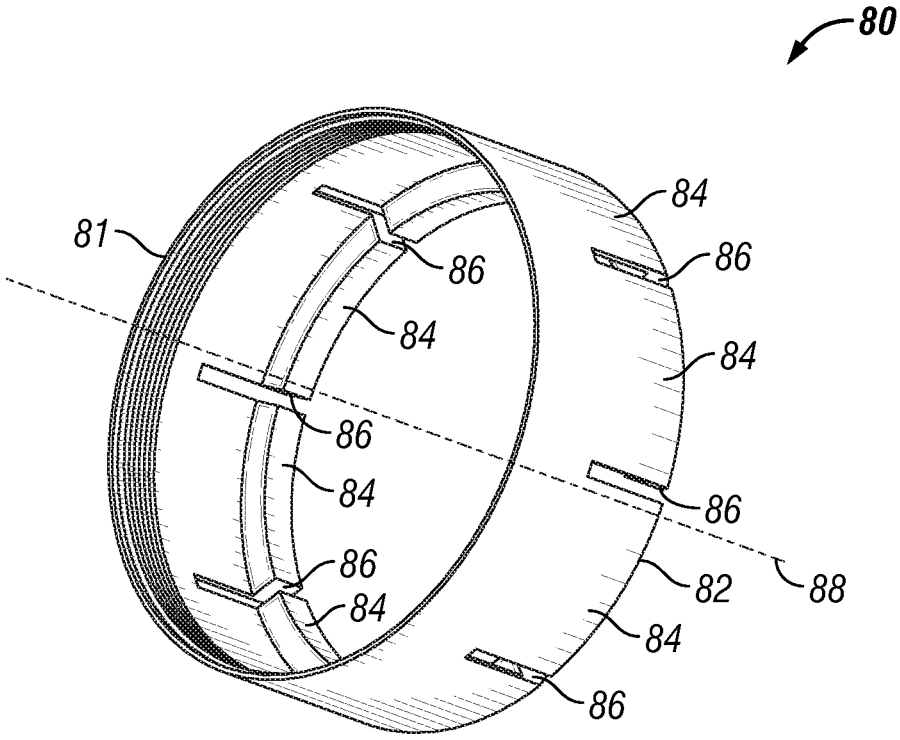
FIG. 3 is a perspective view of the plug element support member shown in FIGS. 1-2.

Referring now to FIGS. 1-3, in one embodiment, apparatus 30 includes tubular member 32 having bore 34 defined by an inner wall surface 36 and having axis 38. Inner wall surface 36 is divided into two portions, upper portion 40 and lower portion 42. Ramp surface 44 transitions between upper portion 40 and lower portion 42. As shown, upper portion 40 has upper diameter 41 that is greater than lower diameter 43 of lower portion 42.

Attachment members such as threads (not shown) can be disposed along inner wall surface 36 or the outer wall surface of tubular member 32 at the upper and lower ends of tubular member 32 for securing apparatus 30 to a string of conduit, such as a work string, or string of tubing.

Disposed with tubular member 32 is plug element seat member 50. Plug element seat member 50 comprises sleeve 52 having outer wall surface 54, inner wall surface 56 and bore 58. Disposed at a lower end of inner wall surface 56 of sleeve 50 is seat 60 for receiving a plug element, shown as ball 100 in FIG. 2. Outer wall surface 54 of sleeve 50 is in sliding engagement with inner wall surface 36 so that plug element seat member 50 has a run-in position (FIG. 1) and a set position (FIG. 2). Seal 59 is used to prevent leakage of fluid between outer wall surface 54 and inner wall surface 36.

Operatively associated with plug element seat member 50 is plug element support member 70. Plug element support member 70 comprises inner wall surface 72 and outer wall surface 74. Although plug element support member 70 may be operatively associated with sleeve 50 in any manner, as shown in the embodiment of FIGS. 1-3 plug element support member 70 is operatively associated with sleeve 50 by flange 55 of sleeve 50 being disposed above and engagement with upper end 78 of plug element support member 70. In addition, inner wall surface 72 is connected to outer wall surface 54 of sleeve 50 such an attachment member such as threads 77. Although plug element support member 70 is shown as being operatively associated with plug element seat member 50 through both flange 55 and threads 77, it is to be understood that both flange 55 and threads 77 are not required. Instead, only one of flange 55 or threads 77 may be present.

Further, as shown in FIGS. 1-2, inner wall surface 72 is not in contact with outer wall surface 54 along the entire longitudinal length of inner wall surface 72. As a result, the lower end of plug element support member 70 has room to flex inwardly as it is moved from its expanded position (FIG. 1) to its contracted position (FIG. 2).

Outer wall surface 74 is in sliding engagement with inner wall surface 36 of tubular member 32. As shown in FIGS. 1-3, outer wall surface 74 comprises ramp engagement surface 76. As discussed in greater detail below, ramp engagement surface 76 is in sliding engagement with ramp surface 44 of inner wall surface 36 of tubular member 30 so that plug element support member 70 has an expanded position (FIG. 1) and a plurality of contracted positions, the fully contracted position being shown in FIG. 2 in which plug element support member 70 engages plug element 100 (FIG. 2). Although plug element support member 70 can comprise other designs to provide the additional support to the plug element, in the embodiment of FIGS. 1-3, plug element support member 70 is collet 80.

Referring to FIG. 3, collet 80 comprises upper end 81, lower end 82 and a plurality of fingers 84 separated by slots 86. Slots 86 facilitate fingers 84 to move inwardly toward axis 88 of collet 80 during movement of collet 80 from the expanded position (FIGS. 1 and 3) to the contracted position (FIG. 2).

In one operation of this embodiment, apparatus 30 is disposed in a string of conduit with a downhole tool (not shown), such as a packer or a bridge plug located above apparatus 30. The string of conduit is run-in a wellbore until the string is located in the desired position. Plug element 100 is dropped down the string of conduit and landed on seat 60. Fluid, such as hydraulic fluid, is pumped down the string of conduit causing downward force or pressure to act on plug element 100. When the pressure or downward force of the fluid above seat 60 reaches a certain, usually predetermined, pressure, sleeve 50 begins moving downward from its run-in position (FIG. 1) toward its set position (FIG. 2). In so doing, sleeve 50 forces plug element support member 70 downward. As a result, ramp surface 44 forces the lower end of plug element support member 70 inwardly toward axis 38 of tubular member 32 until plug element support member 70 is moved to its contracted position (FIG. 2). Upon reaching its contracted position, plug element support member 70 engages plug element 100 to provide additional support directly to plug element 100.

Although plug element support member 70 is shown in the Figures as engaging plug element 100 to provide additional support directly to plug element 100, it is to be understood that plug element support member 70 may also, or alternatively, engage a bottom surface of sleeve 50 to provide additional support to plug element 100.

After actuation of a downhole tool by the increased pressure of the fluid above plug element 100, or after the increased pressure of the fluid above plug element 100 has been used for its intended purpose, fluid is no longer pumped down the string of conduit. As a result, the downward force caused by the pressurization of the fluid above plug element 100 decreases. In embodiments in which plug element support member 70 is collet 80, collet 80 becomes energized when in its contracted position (FIG. 2). In other words, collet 80 is biased toward the expanded position (FIG. 1). Therefore, when the pressure above plug element 100 decreases sufficiently, collet fingers 84 move back toward the expanded position (FIG. 1). As a result, plug element support member 70 and sleeve 50 move upward toward their respective run-in and expanded positions.

Alternatively, before sleeve 50 and plug element support member 70 are moved toward their respective run-in and expanded positions, plug element 100 can be removed through methods and using devices known to persons of ordinary skill in the art, e.g., milling, dissolving, or fragmenting plug element 100. Alternatively, plug element 100 may be a lightweight "float" plug element such that, when pressure is reduced, plug element 100 is permitted to float up to the top of the well.

It is to be understood that the invention is not limited to the exact details of construction, operation, exact materials, or embodiments shown and described, as modifications and equivalents will be apparent to one skilled in the art. For example, the size of the plug element support member can be any size or shape desired or necessary to be moved from the expanded position to the contracted position to provide support to the plug element. Additionally, although the apparatuses described in greater detail with respect to the Figures are ball seats having a ball as their respective plug elements, it is to be understood that the apparatuses disclosed herein may be any type of seat known to persons of ordinary skill in the art that include at least one plug element support member. For example, the apparatus may be a drop plug seat, wherein the drop plug temporarily restricts the flow of fluid through the wellbore. Therefore, the term "plug" as used herein encompasses a ball as shown in the Figures, as well as any other type of device that is used to restrict the flow of fluid through a ball seat. Further, in all of the embodiments discussed with respect to the Figures, upward, toward the surface of the well (not shown), is toward the top of the Figures, and downward or downhole (the direction going away from the surface of the well) is toward the bottom of Figures. However, it is to be understood that the ball seats may have their positions rotated. Accordingly, the ball seats can be used in any number of orientations easily determinable and adaptable to persons of ordinary skill in the art. Accordingly, the invention is therefore to be limited only by the scope of the appended claims.

What is claimed is:

1. An apparatus for restricting flow through a well conduit, the apparatus comprising:

a tubular member comprising an inner wall surface defining a longitudinal bore, the inner wall surface comprising an upper portion having an upper portion diameter, a lower portion having a lower portion diameter, and a ramp surface disposed between the upper portion and the lower portion, the upper diameter being greater than the lower diameter;

a seat disposed within the longitudinal bore, the seat comprising a sleeve having an outer wall surface and an inner wall surface, the outer wall surface being in sliding engagement with the inner wall surface of the tubular member and the inner wall surface comprising a plug element engagement surface for receiving a plug element, the seat having a first position when the apparatus is in a run-in position and a second position when the apparatus is in a set position;

a plug element support member operatively associated with the sleeve and the ramp surface, the plug element support member being in direct sliding engagement with the inner wall surface of the tubular member, the plug element support member having an expanded position when the apparatus is in the run-in position and a contracted position when the apparatus is in the set position, the contracted position comprising a portion of the plug element support member being disposed in the bore of the lower portion of the tubular member; and a plug element adapted to be disposed into the bore and landed on the seat to restrict fluid flow through the bore causing the sleeve to move from the first position to the second position, wherein movement of the sleeve from the first position to the second position causes the plug element support member to move from the expanded position to the contracted position thereby providing support to the plug member landed on the seat.

2. The apparatus of claim 1, wherein the plug element support member is a collet.

3. The apparatus of claim 2, wherein the collet comprises an upper end operatively associated with the sleeve and a lower end operatively associated with the ramp surface, the lower end comprising at least one slot.

4. The apparatus of claim 3, wherein the collet is biased toward the expanded position.

5. The apparatus of claim 1, wherein the plug element support member comprises a ramp engagement surface at a lower end of the plug element support member, the ramp engagement surface being in sliding engagement with the ramp surface disposed on the inner wall surface of the tubular member.

6. The apparatus of claim 1, wherein an inner wall surface of the plug element support member is secured to the outer wall surface of the sleeve.

7. The apparatus of claim 1, wherein the sleeve comprises a flange disposed on the outer wall surface of the sleeve and the plug element support member comprises an upper end in contact with the flange.

8. An apparatus for restricting flow through a well conduit, the apparatus comprising:

a tubular member comprising an inner wall surface defining a longitudinal bore, the inner wall surface comprising an upper portion having an upper portion diameter, a lower portion having a lower portion diameter, and a ramp surface disposed between the upper portion and the lower portion, the upper diameter being greater than the lower diameter;

a seat disposed within the longitudinal bore, the seat comprising a sleeve having an outer wall surface and an inner wall surface, the outer wall surface being in sliding engagement with the inner wall surface of the tubular member and the inner wall surface comprising a plug element engagement surface for receiving a plug element, the seat having a first position when the apparatus is in a run-in position and a second position when the apparatus is in a set position;

a plug element support member operatively associated with the sleeve and the ramp surface, the plug element support member being in sliding engagement with the inner wall surface of the tubular member, the plug element support member having an expanded position when the apparatus is in the run-in position and a contracted position when the apparatus is in the set position, the contracted position comprising a portion of the plug element support member being disposed in the bore of the lower portion of the tubular member, wherein a portion of the plug element support member is disposed between the inner wall surface of the tubular member and the outer wall surface of the seat; and a plug element adapted to be disposed into the bore and landed on the seat to restrict fluid flow through the bore causing the sleeve to move from the first position to the second position, wherein movement of the sleeve from the first position to the second position causes the plug element support member to move from the expanded position to the contracted position thereby providing support to the plug member landed on the seat.

* * * * *